US009932949B2

(12) United States Patent
Matsuo et al.

(10) Patent No.: US 9,932,949 B2
(45) Date of Patent: Apr. 3, 2018

(54) HIGH PRESSURE PUMP

(71) Applicant: DENSO CORPORATION, Kariya, Aichi-pref. (JP)

(72) Inventors: Tetsuharu Matsuo, Kariya (JP); Hiroatsu Yamada, Kariya (JP); Noriya Matsumoto, Kariya (JP); Seiji Tanizawa, Kariya (JP); Shinobu Oikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 263 days.

(21) Appl. No.: 14/927,555

(22) Filed: Oct. 30, 2015

(65) Prior Publication Data

US 2016/0131097 A1 May 12, 2016

(30) Foreign Application Priority Data

Nov. 7, 2014 (JP) ..... 2014-226748
Jul. 17, 2015 (JP) ..... 2015-142760

(51) Int. Cl.

| | |
|---|---|
| ***F02M 55/04*** | (2006.01) |
| ***F02M 59/02*** | (2006.01) |
| ***F04B 11/00*** | (2006.01) |
| ***F04B 53/16*** | (2006.01) |

(52) U.S. Cl.

CPC ..... *F02M 59/025* (2013.01); *F02M 55/04* (2013.01); *F04B 11/00* (2013.01); *F04B 53/16* (2013.01); *F02M 2200/31* (2013.01)

(58) Field of Classification Search

CPC .. F02M 55/04; F02M 2200/31; F02M 59/025; F04B 11/00; F04B 53/16

See application file for complete search history.

(56) References Cited

U.S. PATENT DOCUMENTS

2009/0288639 A1* 11/2009 Usui ..... F02M 55/04 123/457
2010/0209274 A1* 8/2010 Oikawa ..... F04B 37/12 417/540
2011/0186018 A1* 8/2011 Inoue ..... F02M 37/00 123/514
2012/0312278 A1* 12/2012 Usui ..... F02M 59/462 123/446
2014/0099215 A1* 4/2014 Kawano ..... F02M 59/368 417/279
2017/0167450 A1* 6/2017 Spakowski ..... F02M 31/20

* cited by examiner

*Primary Examiner* — Hieu T Vo
*Assistant Examiner* — Sherman Manley
(74) *Attorney, Agent, or Firm* — Nixon & Vanderhye P.C.

(57) ABSTRACT

A partitioning portion partitions a fuel chamber into a first space, which receives a pressurizing chamber forming portion and is communicated with an inflow pipe, and a second space, which is communicated with an outflow pipe. A flow passage forming portion extends from the partitioning portion toward the first space side and forms a communicating flow passage, which communicates between the first space and the second space. Thereby, vapor contained in the fuel, which is returned from a pressurizing chamber to the fuel chamber, is accumulated as bubbles in the first space, which receives the pressurizing chamber forming portion. The first space is communicated with the outside through the communicating flow passage and the second space. Therefore, outputting of air bubbles of the first space to the outside can be effectively limited in comparison to a case where the fuel chamber is directly communicated with the outside.

17 Claims, 16 Drawing Sheets

HIGH PRESSURE PUMP

CROSS REFERENCE TO RELATED APPLICATION

This application is based on and incorporates herein by reference Japanese Patent Application No. 2014-226748 filed on Nov. 7, 2014 and Japanese Patent Application No. 2015-142760 filed on Jul. 17, 2015.

TECHNICAL FIELD

The present disclosure relates to a high pressure pump, which pressurizes and discharges fuel.

BACKGROUND

Previously, there is known a fuel supply system that includes a high pressure pump, which pressurizes relatively low pressure fuel drawn through a fuel pump and supplies the pressurized fuel to high pressure fuel injection valves, while supplying low pressure fuel to, for example, low pressure fuel injection valves. In JP5401369B2 (corresponding to US2012/0312278A1), low pressure fuel is supplied to low pressure fuel injection valves through a fuel chamber of the high pressure pump.

A plunger of the high pressure pump reciprocates even when the fuel is not discharged from the high pressure pump. At this time, the fuel, which is drawn into the pressurizing chamber, is not pressurized and is returned to the fuel chamber. However, when the fuel is not discharged from the high pressure pump, the function of outputting the frictional heat, which is generated through the slide movement of the plunger, along with the fuel discharged from the high pressure pump is lost. Therefore, the fuel, which is returned from the pressurizing chamber to the fuel chamber, is heated to the high temperature by the frictional heat and may possibly contain vapor. Thus, in JP5401369B2 (corresponding to US2012/0312278A1), bubbles, which are accumulated in the fuel chamber, may possibly be outputted along with the low pressure fuel to cause generation of cavitation erosion in a conduit of a supply destination.

SUMMARY

The present disclosure is made in view of the above disadvantage.

According to the present disclosure, there is provided a high pressure pump that includes a housing, a plunger, a cover, a primary inside-to-outside communicating portion, a secondary inside-to-outside communicating portion, a partitioning portion and a flow passage forming portion. The housing includes a pressurizing chamber forming portion, which forms a pressurizing chamber. The plunger is movable to increase and decrease a volume of the pressurizing chamber. The cover defines a fuel chamber between the cover and the housing. The fuel chamber is communicatable with the pressurizing chamber. The primary inside-to-outside communicating portion communicates between the fuel chamber and an outside. The secondary inside-to-outside communicating portion communicates between the fuel chamber and the outside. The partitioning portion partitions the fuel chamber into a first space and a second space. The first space receives the pressurizing chamber forming portion and is communicated with an inside flow passage of the primary inside-to-outside communicating portion. The second space is communicated with an inside flow passage of the secondary inside-to-outside communicating portion. The flow passage forming portion forms a communicating flow passage, which extends from the partitioning portion toward the first space side and communicates between the first space and the second space.

BRIEF DESCRIPTION OF THE DRAWINGS

The drawings described herein are for illustration purposes only and are not intended to limit the scope of the present disclosure in any way.

DETAILED DESCRIPTION

Figure 1:
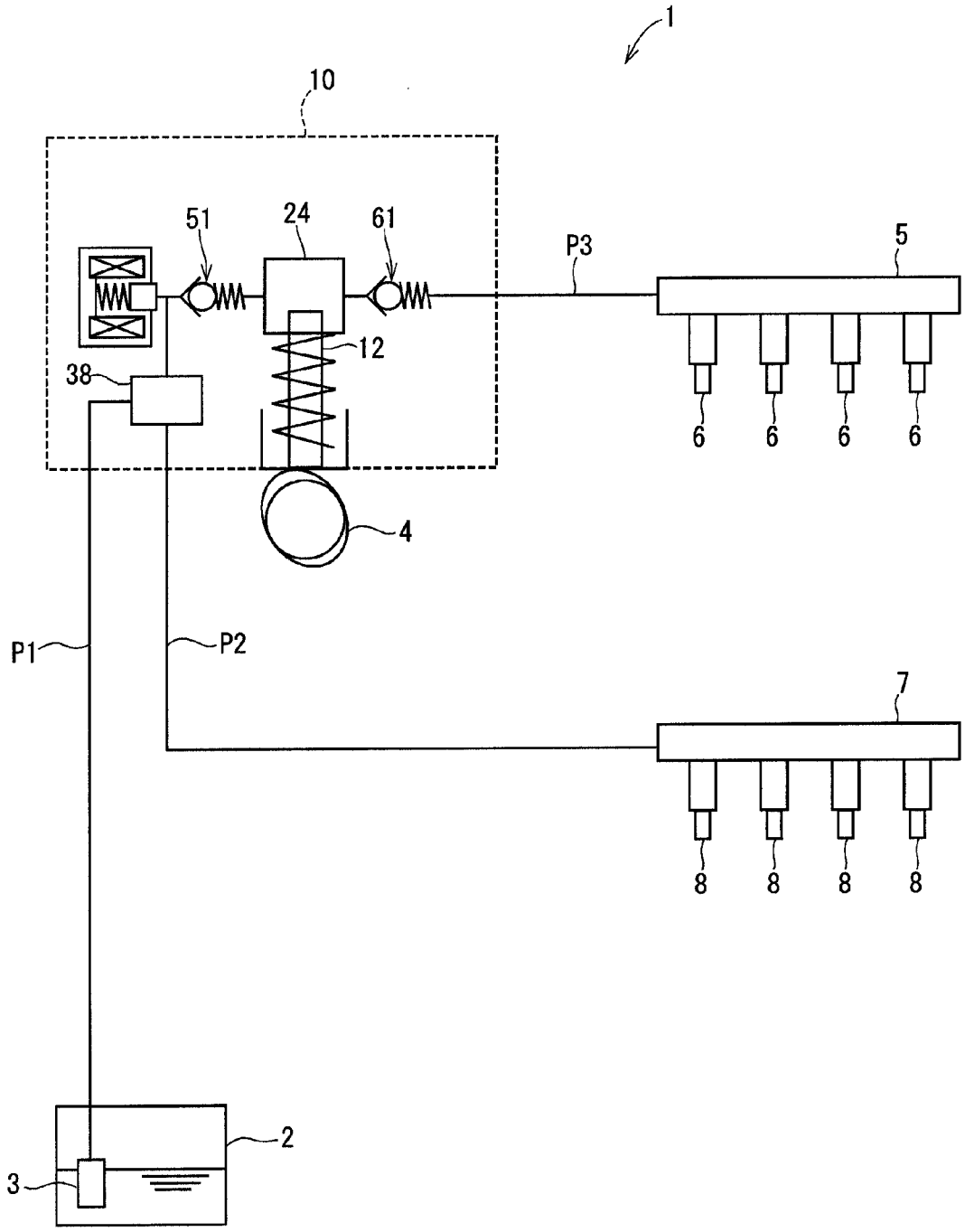
FIG. 1 is a schematic diagram indicating a fuel injection system having a high pressure pump according to a first embodiment of the present invention.

Various embodiments of the present disclosure will be described with reference to the accompanying drawings. In the following discussion of the embodiments, similar components will be indicated by the same reference numerals and will not be described redundantly for the sake of simplicity.

First Embodiment

FIG. 1 shows a fuel injection system having a high pressure pump according to a first embodiment of the present disclosure. In the fuel injection system 1, fuel of a relatively low pressure, which is drawn from a fuel tank 2 through a fuel pump 3, is supplied to a fuel chamber 38 of a high pressure pump 10 through a low pressure fuel conduit P1.

When a plunger 26, which is reciprocated along a profile of a cam 4, is moved downward, the fuel of the fuel chamber 38 is drawn into a pressurizing chamber 24. Then, when the plunger 26 is moved upward upon closing of the pressurizing chamber 24 with the suction valve 51, the fuel is pressurized in the pressurizing chamber 24. The fuel, which is pressurized in the pressurizing chamber 24, opens the discharge valve 61, so that the fuel is supplied to a high pressure fuel rail 5 through a high pressure fuel conduit P3. The high pressure fuel, which is accumulated in the high pressure fuel rail 5, is directly injected into cylinders of an internal combustion engine through high pressure fuel injection valves 6.

Also, a portion of the fuel in the fuel chamber 38 is supplied to a low pressure fuel rail 7 through a low pressure fuel conduit P2. The low pressure fuel, which is accumulated in the low pressure fuel rail 7, is injected into intake ports of the engine through low pressure fuel injection valves 8. The fuel pump 3 pressurizes the fuel to a corresponding pressure that enables the injection of the fuel though the low pressure fuel injection valves 8.

Figure 2:
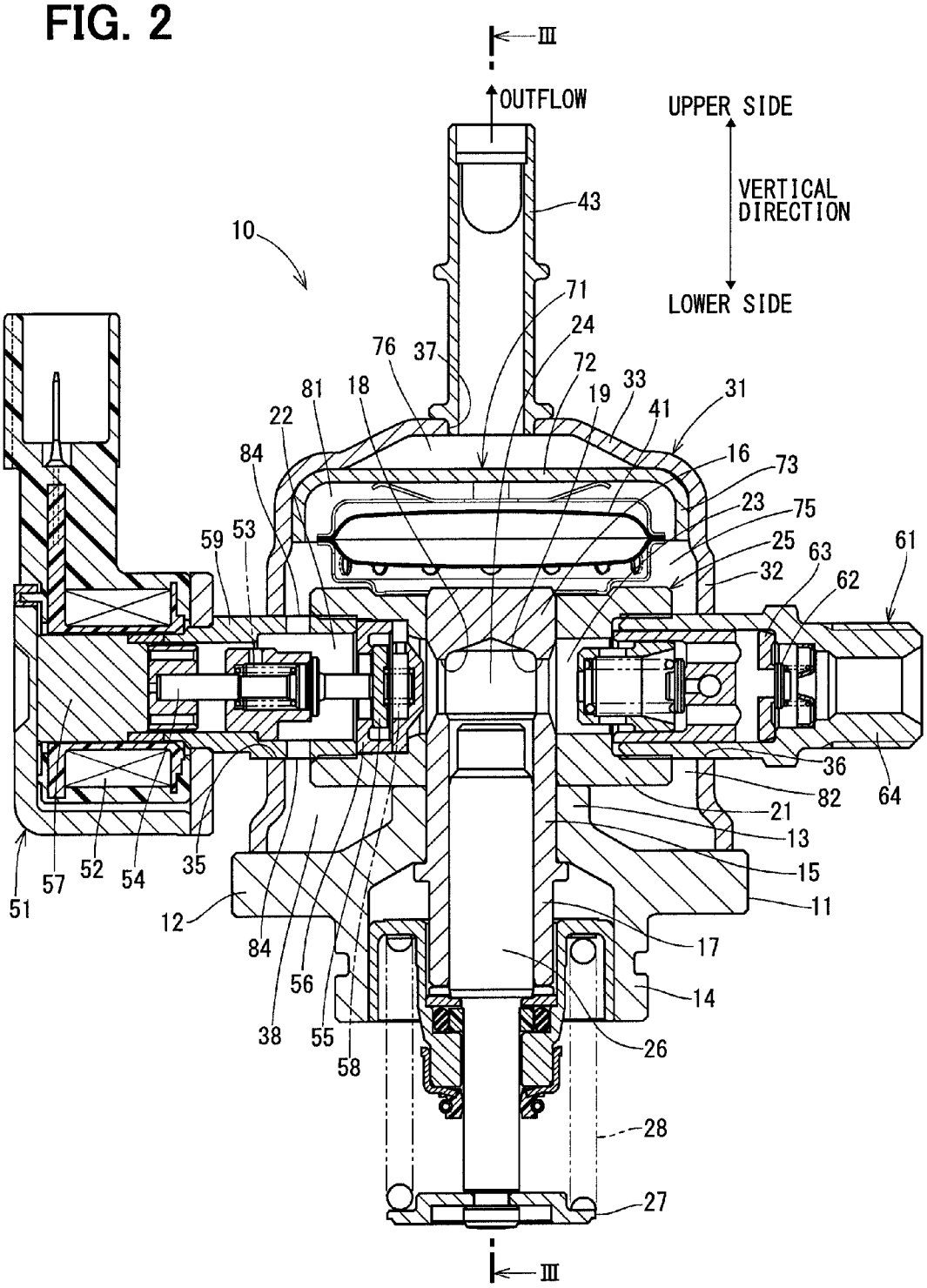
FIG. 2 is a partial cross sectional view of the high pressure pump of FIG. 1.
Figure 3:
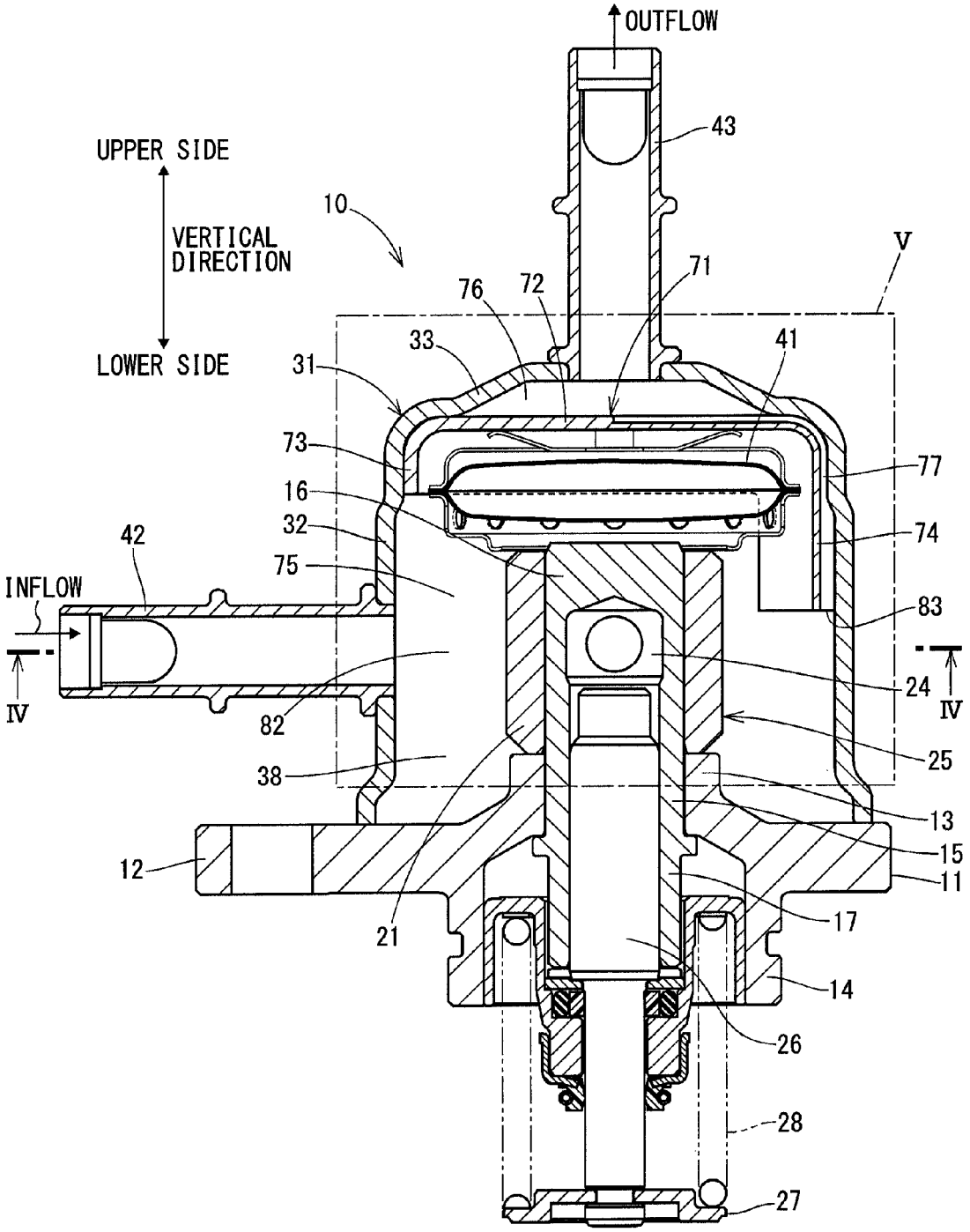
FIG. 3 is a cross sectional view taken along line III-III in FIG. 2.
Figure 4:
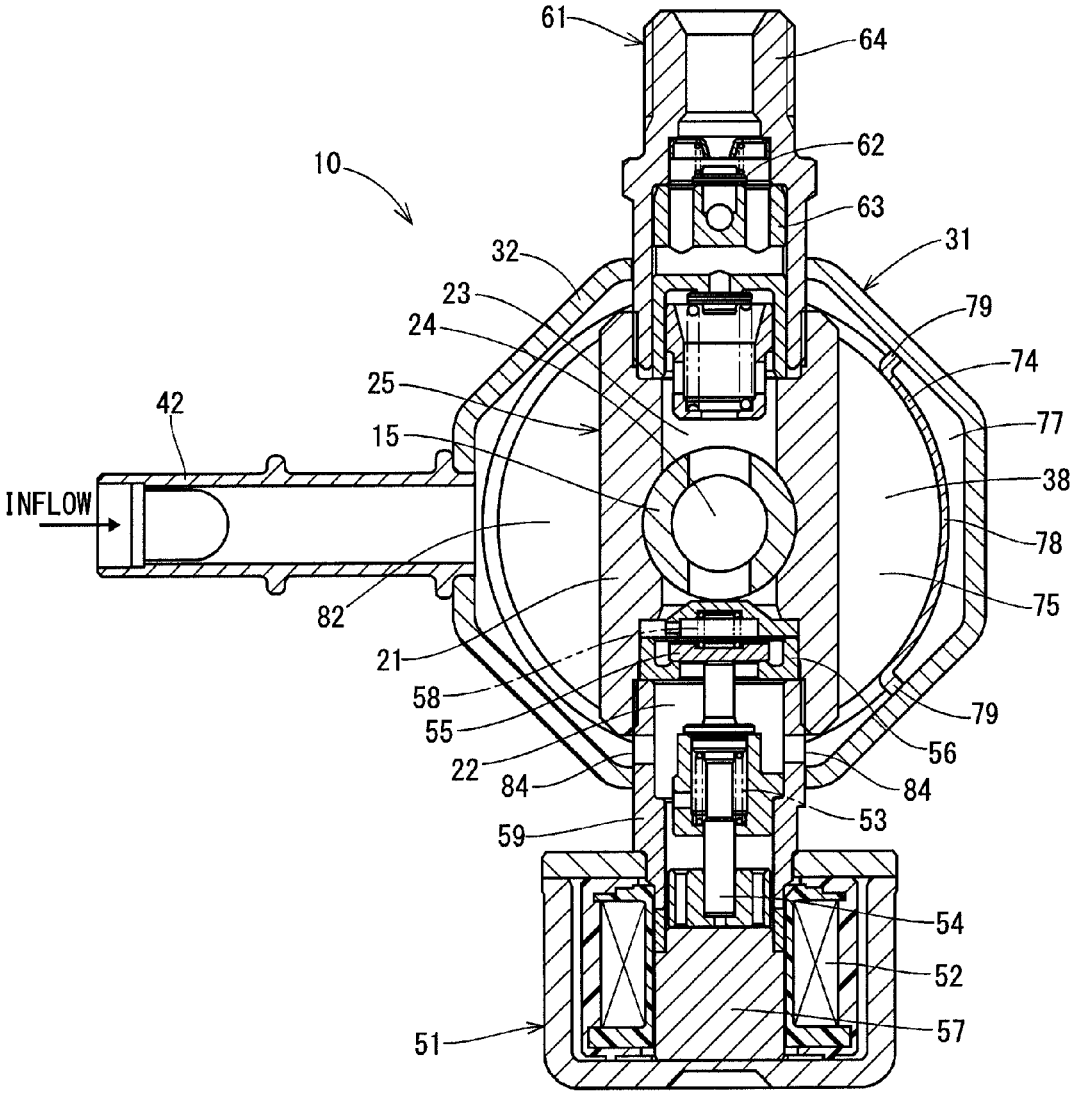
FIG. 4 is a cross sectional view taken along line IV-IV in FIG. 3.
Figure 5:
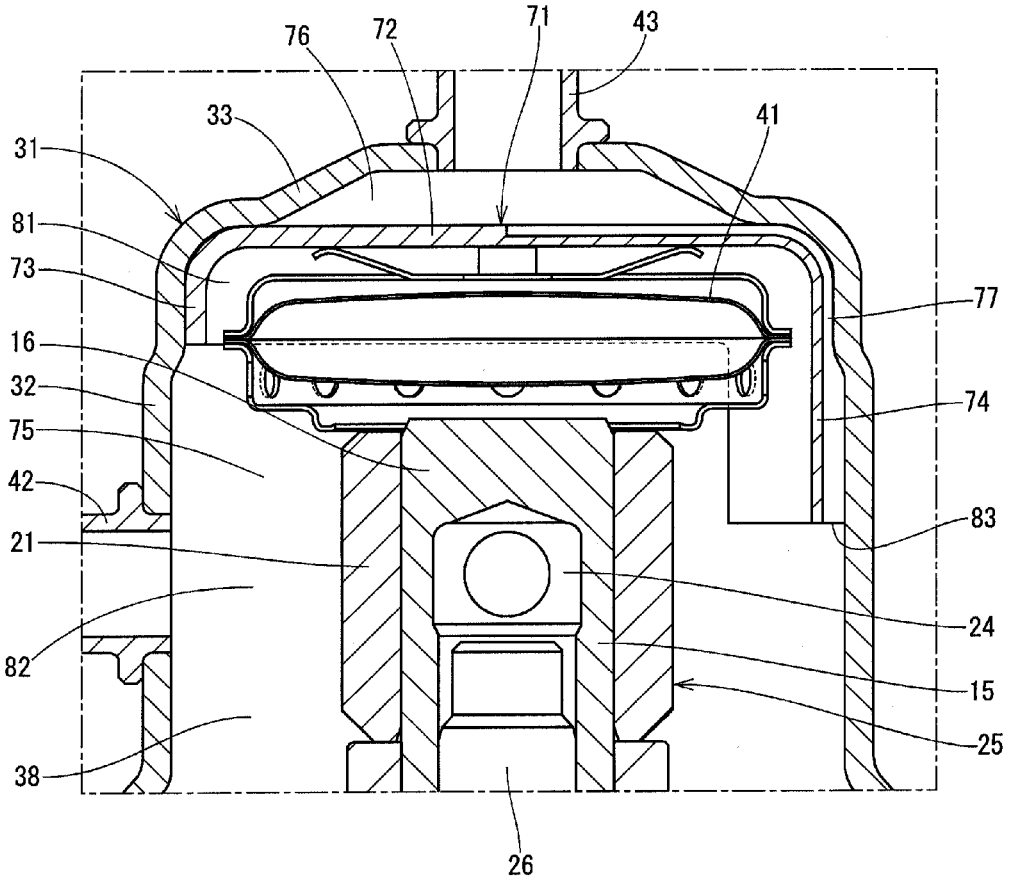
FIG. 5 is a partial enlarged view showing an area V in FIG. 3.

First of all, an entire structure of the high pressure pump 10 will be described with reference to FIGS. 2 to 4. FIG. 2 indicates an installation state of the high pressure pump 10. In the following description, an upper side and a lower side in a vertical direction will be described with reference to the installation state of FIG. 2.

The high pressure pump 10 includes a lower housing 11, a cylinder 15, an upper housing 21, the plunger 26, a cover 31, a pulsation damper 41, an inflow pipe 42, an outflow pipe 43, a suction valve 51 and a discharge valve 61.

The lower housing 11 includes a flange portion 12, a cylinder holding portion 13 and an engine engaging portion 14. The flange portion 12 is fixable to the engine. The cylinder holding portion 13 is configured into a tubular form and projects upward from the flange portion 12. The engine engaging portion 14 is configured into a tubular form and projects downward from the flange portion 12.

The cylinder 15 is configured into a cylindrical form having a bottom. A bottom side end portion 16 of the cylinder 15 is placed on an upper side of an opening side end portion 17 of the cylinder 15. The opening side end portion 17 is press fitted into an inside of the cylinder holding portion 13 of the lower housing 11 and is thereby secured to the cylinder holding portion 13. The bottom side end portion 16 includes a suction hole 18 and a discharge hole 19, which extend through the bottom side end portion 16 in a radial direction.

The upper housing 21 is press fitted to an outer side of the bottom side end portion 16 of the cylinder 15 and is thereby secured to the outer side of the bottom side end portion 16. The upper housing 21 includes a suction flow passage 22, which is communicated with the suction hole 18, and a discharge flow passage 23, which is communicated with the discharge hole 19. The suction valve 51 is installed to the suction flow passage 22, and a discharge valve 61 is installed to the discharge flow passage 23.

An inside space of the cylinder 15, the suction hole 18, the discharge hole 19, a portion of the suction flow passage 22, and a portion of the discharge flow passage 23 define a pressurizing chamber 24. The pressurizing chamber 24 is closed by the plunger 26, the suction valve 51 and the discharge valve 61 at the valve closing time. The bottom side end portion 16 of the cylinder 15 and the upper housing 21 correspond to a pressurizing chamber forming portion of the present disclosure and will be indicated as the pressurizing chamber forming portion 25. The lower housing 11, the cylinder 15 and the upper housing 21 constitute a housing of the present disclosure.

The plunger 26 is inserted into an inside of the cylinder 15. The plunger 26 is reciprocatable in the axial direction to increase and decrease a volume of the pressurizing chamber 24. The plunger 26 is urged downward by a spring 28 through a spring seat 27, which is fixed to a lower end portion of the plunger 26. The volume of the pressurizing chamber 24 is increased when the plunger 26 is moved downward. In contrast, the volume of the pressurizing chamber 24 is decreased when the plunger 26 is moved upward.

The cover 31 is configured into a tubular form having a bottom. The cover 31 is installed to the pressurizing chamber forming portion 25 from the upper side of the pressurizing chamber forming portion 25. An opening end portion of the cover 31 is fixed to the flange portion 12 of the lower housing 11 by welding. A tubular portion 32 of the cover 31 includes a through-hole 34, to which the inflow pipe 42 is fixed, a through-hole 35, through which the suction valve 51 is inserted, and a through-hole 36, through which the discharge valve 61 is inserted. A bottom portion 33 of the cover 31 includes a through-hole 37, to which the outflow pipe 43 is fixed.

The cover 31 partitions the fuel chamber 38, which is communicatable with the pressurizing chamber 24 and is defined by the lower housing 11, the cylinder 15 and the upper housing 21. The words, "communicatable with the pressurizing chamber 24" mean that it communicates with the pressurizing chamber 24 when the suction valve 51 is opened.

The pulsation damper 41 is a damper that reduces pressure pulsation of the fuel and is placed in the fuel chamber 38.

The inflow pipe 42 is a primary inside-to-outside communicating portion, which communicates between the fuel chamber 38 and the outside, i.e., the low pressure fuel conduit P1. In the present embodiment, this primary inside-to-outside communicating portion, i.e., the inflow pipe 42 is an inflow portion, through which the fuel is supplied to the fuel chamber 38.

The outflow pipe 43 is a secondary inside-to-outside communicating portion, which communicates between the fuel chamber 38 and the outside, i.e., the low pressure fuel conduit P2. In the present embodiment, this secondary inside-to-outside communicating portion, i.e., the outflow pipe 43 is an outflow portion, through which the fuel is outputted from the fuel chamber 38. Alternative to the above-described configuration, the primary inside-to-outside communicating portion (e.g., the pipe 42) may be used as the outflow portion, and the secondary inside-to-outside communicating portion (e.g., the pipe 43) may be used as the inflow portion like a sixth embodiment described with reference to FIG. 10, if desired.

The suction valve 51 is an electromagnetic valve (solenoid valve) that can open and close the suction flow passage 22. When a coil 52 is not energized, a movable element 54, which receives an urging force of a valve opening spring 53, lifts a suction valve element 55 from a suction valve seat member 56. Thus, the suction flow passage 22 is opened. In contrast, when the coil 52 is energized, the movable element 54 is magnetically attracted to the stationary core 57. Thus, the suction valve element 55 is released from the urging force of the movable element 54 and is thereby seated against the suction valve seat member 56 by an urging force of a valve closing spring 58. Thus, the suction flow passage 22 is closed. A suction valve body 59 is received through the through-hole 35 of the cover 31 and is fixed to the upper housing 21. The suction valve seat member 56 is clamped between the suction valve body 59 and the upper housing 21.

The discharge valve 61 can open and close the discharge flow passage 23 in response to the pressure of the fuel in the pressurizing chamber 24. When the pressure of the fuel in the pressurizing chamber 24 is equal to or larger than a predetermined value, a discharge valve element 62, which receives the pressure of the fuel, is lifted from the discharge valve seat member 63. Thus, the discharge flow passage 23 is opened. A discharge valve body 64 is received through the through-hole 36 of the cover 31 and is fixed to the upper housing 21. The discharge valve seat member 63 is clamped between the discharge valve body 64 and the upper housing 21.

In the high pressure pump 10, which is constructed in the above-described manner, the fuel of the fuel chamber 38 is drawn into the pressurizing chamber 24 when the plunger 26 is moved downward at valve opening time of the suction valve 51. The fuel in the pressurizing chamber 24 is urged and is returned to the fuel chamber 38 without being pressurized at the valve opening time of the suction valve 51 even when the plunger 26 is moved upward. In contrast, the fuel in the pressurizing chamber 24 is pressurized at the valve closing time of the suction valve 51 when the plunger 26 is moved upward. When the pressure of the fuel in the pressurizing chamber 24 reaches a pressure that is equal to or higher than a predetermined pressure, the fuel in the pressurizing chamber 24 opens the discharge valve 61 and is discharged to the outside.

Next, the characteristic structure of the high pressure pump 10 will be described with reference to FIGS. 2 to 5.

The high pressure pump 10 further includes a partitioning member 71. The partitioning member 71 forms a partitioning portion 72, a tubular portion 73 and a flow passage forming portion 74.

The partitioning portion 72 partitions the fuel chamber 38 into a first space 75 and a second space 76. The first space 75 is a space that receives the pressurizing chamber forming portion 25 and is communicated with an inside flow passage of the inflow pipe 42. In the present embodiment, the first space 75 is defined in the inside of the tubular portion 73. The second space 76 is a space that is communicated with an inside flow passage of the outflow pipe 43. In the present embodiment, the bottom portion 33 of the cover 31 includes a protrusion that protrudes to the outside. The second space 76 is defined in the inside of this protrusion of the bottom portion 33 of the cover 31. Furthermore, in the present embodiment, the high pressure pump 10 is installed to the vehicle, for example, in such a manner that the partitioning portion 72 is placed on the upper side of the pressurizing chamber forming portion 25 in the vertical direction.

The tubular portion 73 projects from the partitioning portion 72 toward the pressurizing chamber forming portion 25. The partitioning member 71 is fixed to the cover 31 in such a manner that the tubular portion 73 is press fitted to the inner wall of the cover 31 and is thereby secured to the inner wall of the cover 31.

The flow passage forming portion 74 extends from the partitioning portion 72 toward the first space 75 side and forms a communicating flow passage 77, which communicates between the first space 75 and the second space 76. In the present embodiment, the flow passage forming portion 74 includes an arcuate portion 78 and a pair of seal portions (i.e., two seal portions) 79. In a state where a gap is formed between the tubular portion 32 of the cover 31 and the arcuate portion 78 of the flow passage forming portion 74, the arcuate portion 78 extends circumferentially along the tubular portion 73, and the seal portions 79 radially outwardly project from two circumferential ends of the arcuate portion 78 and contact the cover 31 without forming a gap between each seal portion 79 and the cover 31. That is, the flow passage forming portion 74 forms the communicating flow passage 77 between the flow passage forming portion 74 and the cover 31. In the present embodiment, the communicating flow passage 77 is a groove that is formed in the partitioning member 71 and extends from the second space 76 side toward the first space 75 side.

The pulsation damper 41 is placed in the first space 75 at a location that is between the partitioning portion 72 and the pressurizing chamber forming portion 25. The first space 75 includes a damper chamber 81 and an annular flow passage 82. The damper chamber 81 is defined between the pressurizing chamber forming portion 25 and the partitioning portion 72 and receives the pulsation damper 41. The annular flow passage 82 circumferentially surrounds the pressurizing chamber forming portion 25 and is communicated with the inside flow passage of the inflow pipe 42.

The flow passage forming portion 74 extends from the partitioning portion 72 beyond the pulsation damper 41 on the side where the pressurizing chamber forming portion 25 is placed. Furthermore, the flow passage forming portion 74 extends to the annular flow passage 82. In other words, the flow passage forming portion 74 is formed such that an opening 83 of the communicating flow passage 77, which opens to the first space 75, is placed in the annular flow passage 82. The opening 83 is placed on the lower side of the upper end of the pressurizing chamber forming portion 25 in the vertical direction.

The opening 83 of the communicating flow passage 77 is placed at the location, which is not overlapped with the inlet 84 of the suction flow passage 22 in a view taken in the vertical direction. Furthermore, the opening 83 is placed at the location, which is not overlapped with the inlet 84 in the circumferential direction along the annular flow passage 82 and is on an opposite side of the pressurizing chamber forming portion 25, which is opposite from the inflow pipe 42. The suction valve body 59, which includes the inlet 84, corresponds to a member that is fixed to the pressurizing chamber forming portion according to the present disclosure.

In the high pressure pump 10 constructed in the above described manner, the fuel, which is returned from the pressurizing chamber 24 to the fuel chamber 38 at the non-discharging time of the high pressure pump 10, tends to move upward because the temperature of the fuel is increased to a relatively high temperature due to the frictional heat generated through the slide movement of the plunger 26. Therefore, the fuel is concentrated at the damper chamber 81, which is located on the upper side of the inlet 84 of the suction flow passage 22. In a case where the fuel, which has the high temperature, contains vapor, the vapor is accumulated as air bubbles at the upper portion of the damper chamber 81. In contrast, the fuel, which has the relatively low temperature, is concentrated at the lower portion of the first space 75, i.e., is concentrated in the annular flow passage 82. The fuel, which has the relatively low temperature and is located in the annular flow passage 82, is supplied to the second space 76 through the communicating flow passage 77.

Now, advantages of the present embodiment will be described.

As discussed above, in the first embodiment, the partitioning portion 72 partitions the fuel chamber 38 into the first space 75 and the second space 76. The first space 75 receives the pressurizing chamber forming portion 25 and is communicated with the inside flow passage of the inflow pipe 42. The second space 76 is communicated with the inside flow passage of the outflow pipe 43. The flow passage forming portion 74 extends from the partitioning portion 72 toward the first space 75 and forms the communicating flow passage 77, which communicates between the first space 75 and the second space 76.

With the above construction, the vapor, which is contained in the fuel that is returned from the pressurizing chamber 24 to the fuel chamber 38, is accumulated as the bubbles in the first space 75, which receives the pressurizing chamber forming portion 25. The first space 75 is not directly communicated with the outside. Specifically, the first space 75 is communicated with the outside through the communicating flow passage 77 and the second space 76. Therefore, in comparison to a comparative example, in which the fuel chamber 38 is directly communicated with the outside, to which the fuel is outputted, the bubbles in the first space 75 are not easily outputted to the outside according to the present embodiment. Thus, the cavitation erosion of the low pressure fuel conduit P2 of the supply destination, which is caused by the outputting of the bubbles from the fuel chamber 38 to the outside along with the low pressure fuel, can be limited.

Furthermore, in the first embodiment, the tubular portion 73 is formed to project from the partitioning portion 72 toward the pressurizing chamber forming portion 25. Therefore, the partitioning member 71 can be fixed by press fitting the tubular portion 73 to the inner wall of the cover 31. That is, the tubular portion 73 functions as the fixing portion of the partitioning member 71.

Furthermore, in the first embodiment, the opening 83 of the communicating flow passage 77, which opens to the first space 75, is placed on the opposite side of the pressurizing chamber forming portion 25, which is opposite from the inflow pipe 42 in a diametrical direction of the cylinder 15 of the pressurizing chamber forming portion 25. Therefore, the fuel, which has the relatively low temperature and is supplied from the inflow pipe 42 into the first space 75, flows around the pressurizing chamber forming portion 25 and is then directed to the communicating flow passage 77. Thus, the pressurizing chamber forming portion 25 can be effectively cooled with the flow of the low temperature fuel.

Furthermore, according to the first embodiment, the pulsation damper 41 is placed in the first space 75. Thus, the fuel pressure pulsation in the first space 75 can be reduced with the pulsation damper 41.

Furthermore, in the first embodiment, the space is present between the partitioning portion 72 and the pulsation damper 41. Therefore, the bubbles, which are accumulated in the first space 75, are accumulated in the space between the partitioning portion 72 and the pulsation damper 41. Thus, it is possible to limit the reduction of the fuel pressure pulsation reducing effect of the pulsation damper 41, which would be caused by the bubbles described above.

Furthermore, according to the first embodiment, the pulsation damper 41 is placed at the location between the pressurizing chamber forming portion 25 and the partitioning portion 72 in the first space 75. The flow passage forming portion 74 is formed such that the opening 83 of the communicating flow passage 77 located on the first space 75 side is placed on the side of the pulsation damper 41 where the pressurizing chamber forming portion 25 is placed. Therefore, it is possible to reduce the influence of the fuel pressure pulsation on the fuel that flows in the communicating flow passage 77.

Furthermore, in the first embodiment, the first space 75 includes the damper chamber 81 and the annular flow passage 82. The damper chamber 81 is defined between the pressurizing chamber forming portion 25 and the partitioning portion 72 and receives the pulsation damper 41, and the annular flow passage 82 surrounds the pressurizing chamber forming portion 25 and is communicated with the inside flow passage in the inflow pipe 42. The bubbles are accumulated in the damper chamber 81, and the fuel directed from the inflow pipe 42 to the first space 75 is initially introduced in the annular flow passage 82. In the present embodiment, the damper chamber 81 and the annular flow passage 82 are spaced apart from each other. As a result, agitation of the bubbles by the fuel supplied from the inflow pipe 42 into the first space 75 can be limited, and thereby it is possible to limit the flow of the bubbles into the communicating flow passage 77.

Furthermore, according to the first embodiment, the inflow pipe 42 is placed at the lower side of the cover 31. That is, the inflow pipe 42 is communicated with the annular flow passage 82, which is formed at the lower side in the first space 75. Therefore, the fuel, which is supplied from the inflow pipe 42, can be conducted at the lower portion of the first space 75. Thus, it is possible to limit the flow of the high temperature fuel, which is concentrated in the damper chamber 81 located at the upper side of the first space 75, into the communicating flow passage 77.

Furthermore, in the first embodiment, the flow passage forming portion 74 is formed such that the opening 83 of the communicating flow passage 77 located on the first space 75 side is placed in the annular flow passage 82. Thus, it is possible to limit the flow of the high temperature fuel, which is concentrated in the damper chamber 81 at the upper side of the first space 75, into the communicating flow passage 77.

Furthermore, in the first embodiment, the opening 83 of the communicating flow passage 77, which opens to the first space 75, is placed at the location that does not overlap with the inlet 84 of the suction flow passage 22 in the circumferential direction along the annular flow passage 82. Therefore, the inlet 84 of the suction flow passage 22 and the opening 83 of the communicating flow passage 77 are spaced apart from each other. Thereby, the high temperature fuel, which is returned from the inlet 84 to the fuel chamber 38, is limited from flowing into the communicating flow passage 77.

Furthermore, in the first embodiment, the opening 83 of the communicating flow passage 77 is placed at the location, which is not overlapped with the inlet 84 of the suction flow passage 22 in a view taken in the vertical direction. Thus, the high temperature fuel, which is returned from the inlet 84 to the fuel chamber 38, is limited from flowing into the communicating flow passage 77.

Second Embodiment

Figure 6:
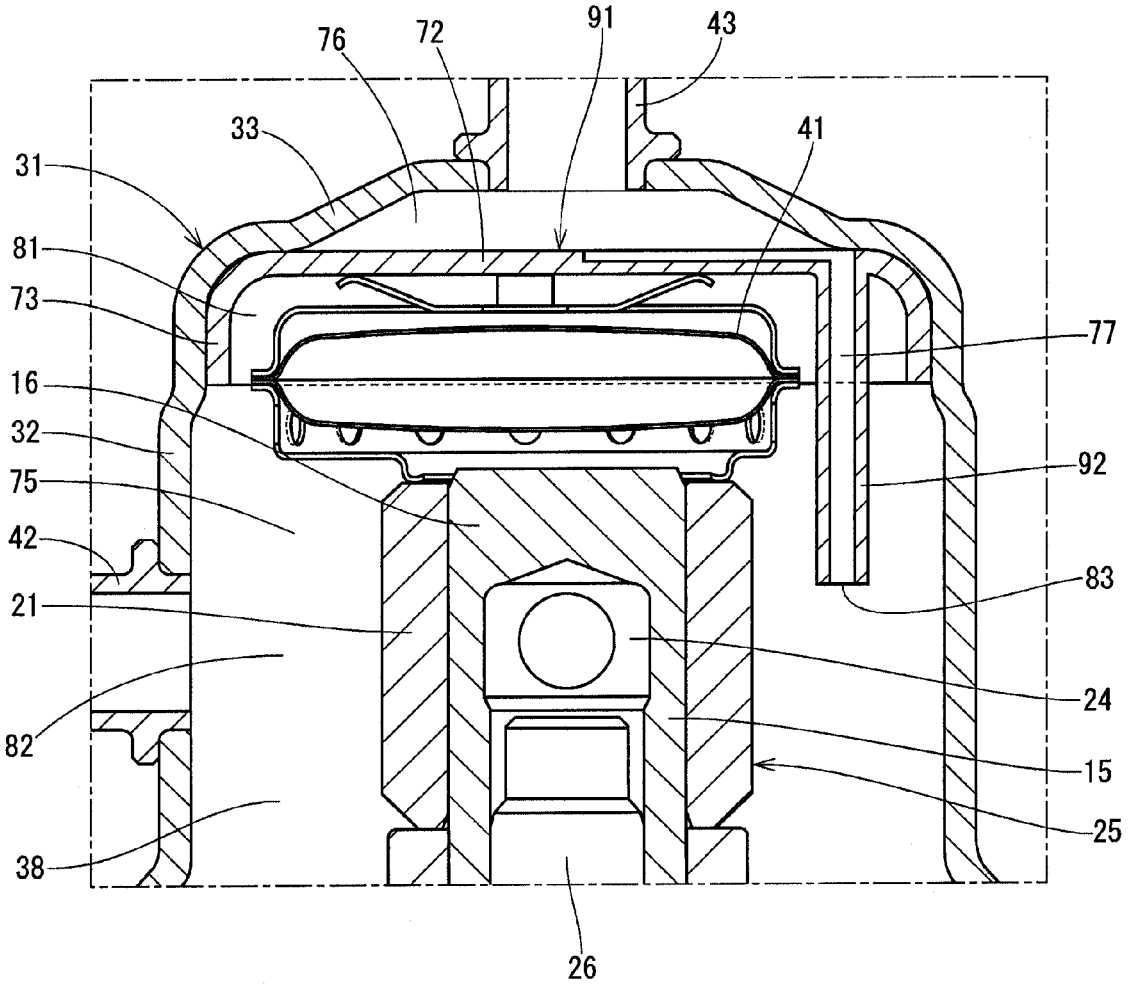
FIG. 6 is a schematic enlarged view of a high pressure pump according to a second embodiment of the present disclosure.

As shown in FIG. 6, according to a second embodiment of the present disclosure, a partitioning member 91 includes the partitioning portion 72, the tubular portion 73 and a flow passage forming portion 92. The flow passage forming portion 92 is configured into a tubular form and includes the communicating flow passage 77 in the inside of the flow passage forming portion 92. Even when the flow passage forming portion 92 forms the communicating flow passage 77 by itself, the advantages, which are similar to those discussed in the first embodiment, can be achieved.

Third Embodiment

Figure 7:
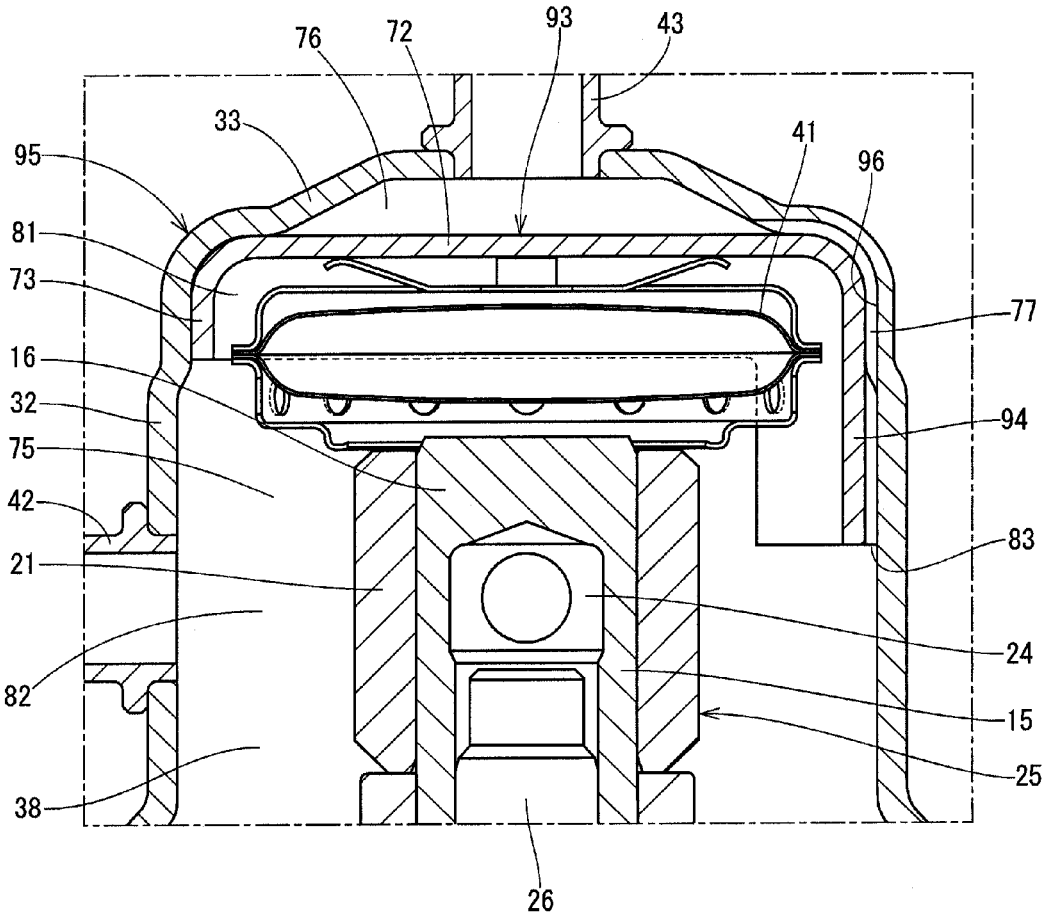
FIG. 7 is a schematic enlarged view of a high pressure pump according to a third embodiment of the present disclosure.

As shown in FIG. 7, according to a third embodiment of the present disclosure, a partitioning member 93 includes the partitioning portion 72, the tubular portion 73 and a flow passage forming portion 94. The flow passage forming portion 94 forms the communicating flow passage 77 between the flow passage forming portion 94 and a groove 96, which is formed in an inner wall of a cover 95. Even though the flow passage forming portion 94 forms the communicating flow passage 77 by itself, the advantages, which are similar to those discussed in the first embodiment, can be achieved.

Fourth Embodiment

Figure 8:
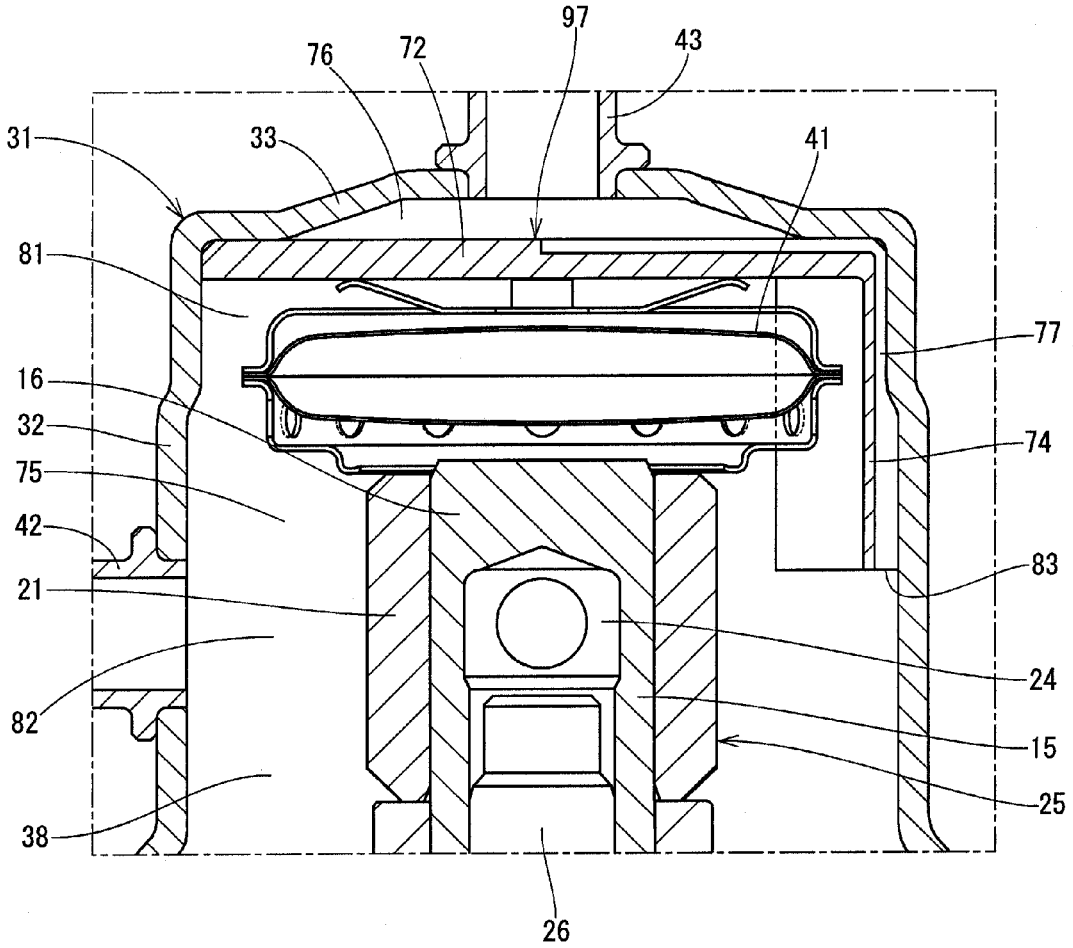
FIG. 8 is a schematic enlarged view of a high pressure pump according to a fourth embodiment of the present disclosure.

As shown in FIG. 8, according to a fourth embodiment of the present disclosure, a partitioning member 97 includes the partitioning portion 72 and the flow passage forming portion 74. The partitioning portion 72 is press fitted to the inner wall of the cover 31 and is thereby secured to the inner wall of the cover 31. The partitioning portion 72 functions as a securing portion of the partitioning member 97. As discussed above, even when the partitioning member 97 does not have the tubular portion, the partitioning member 97 can be secured to the cover 31. Thereby, the advantages, which are similar to those of the first embodiment, can be achieved.

Fifth Embodiment

Figure 9:
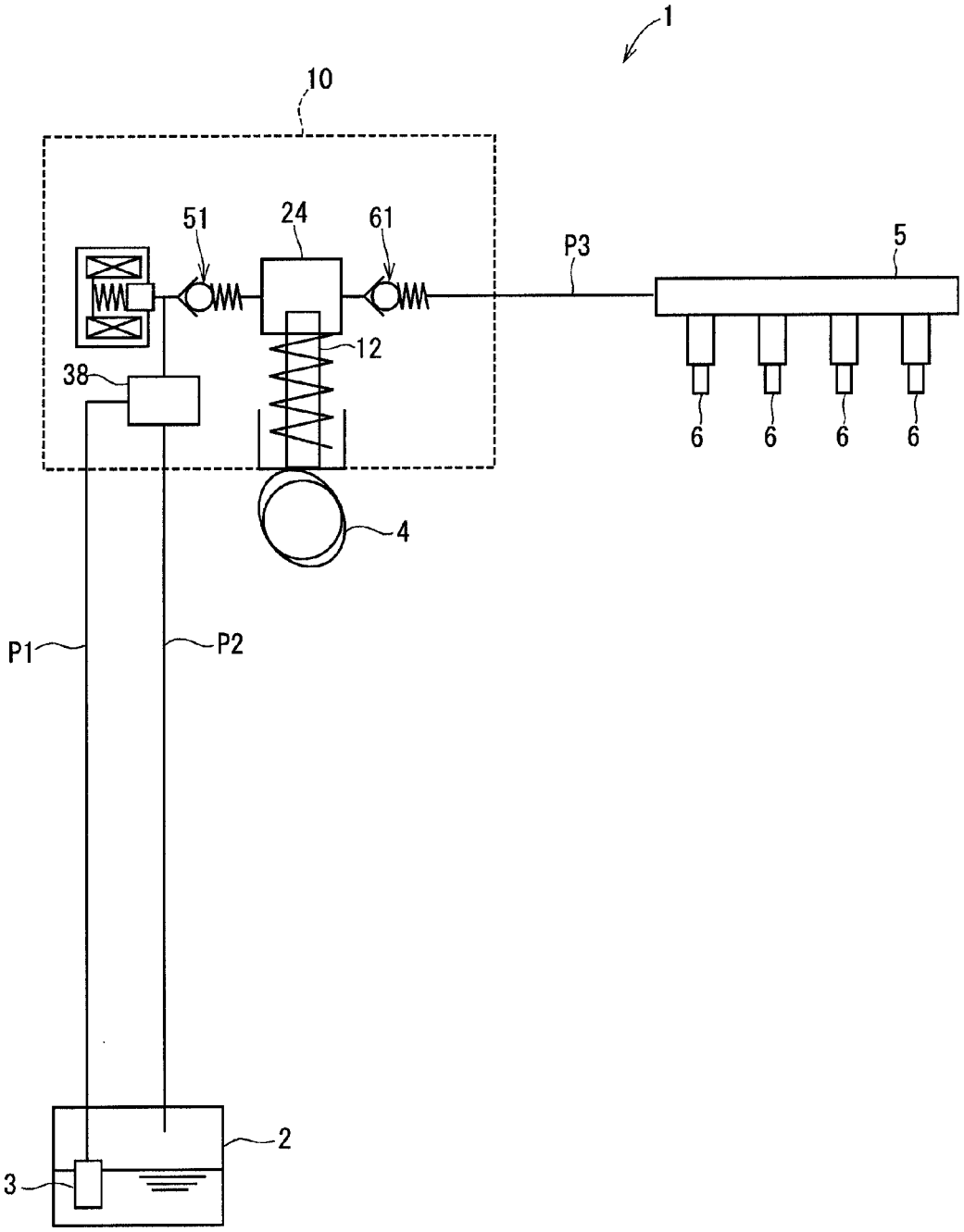
FIG. 9 is a schematic diagram showing a fuel injection system having a high pressure pump according to a fifth embodiment of the present invention.

As shown in FIG. 9, according to a fifth embodiment of the present disclosure, the low pressure fuel conduit P2 may communicate between the outflow pipe 43 and the fuel tank 2, and the fuel, which is outputted from the fuel chamber 38 to the outflow pipe 43, may be returned to the fuel tank 2.

Sixth Embodiment

Figure 10:
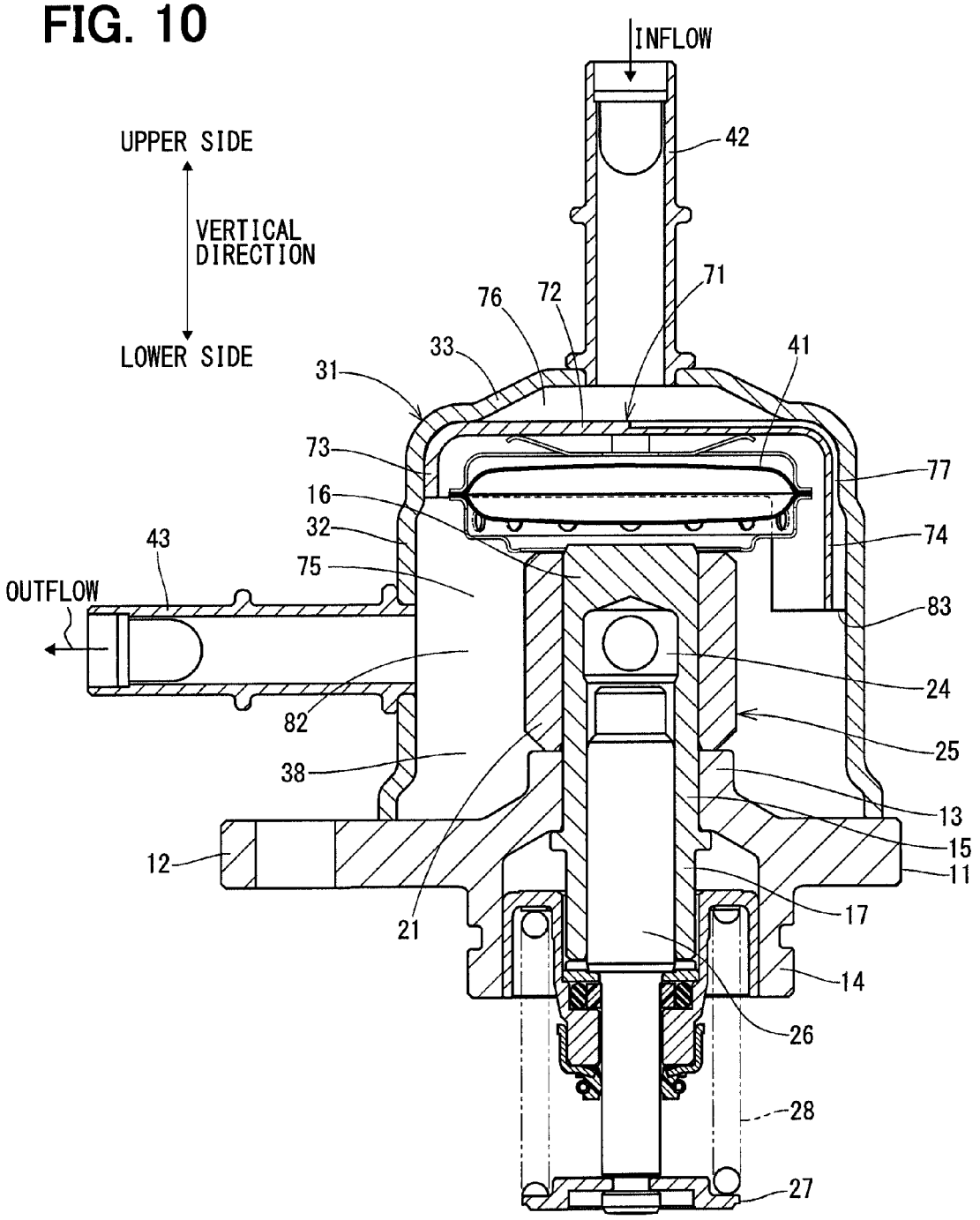
FIG. 10 is a partial cross-sectional view of a high pressure pump according to a sixth embodiment of the present disclosure.

As shown in FIG. 10, according to a sixth embodiment of the present disclosure, the inflow pipe 42 may be installed to the bottom portion 33 of the cover 31, and the outflow pipe 43 may be installed to the tubular portion 32 of the cover 31. In this way, the inside flow passage of the inflow pipe 42 is directly communicated with the second space 76, and the inside flow passage of the outflow pipe 43 is directly communicated with the first space 75.

Seventh Embodiment

In the first to sixth embodiments, the fuel of the inflow pipe 42 flows across the first space 75 and is conducted to the outflow pipe 43. Therefore, although the damper chamber 81 and the annular flow passage 82, which form the first space 75, are spaced apart from each other, the fuel pressure pulsation of the damper chamber 81 tends to be applied to a main flow of the fuel, which flows in the annular flow passage 82.

Figure 11:
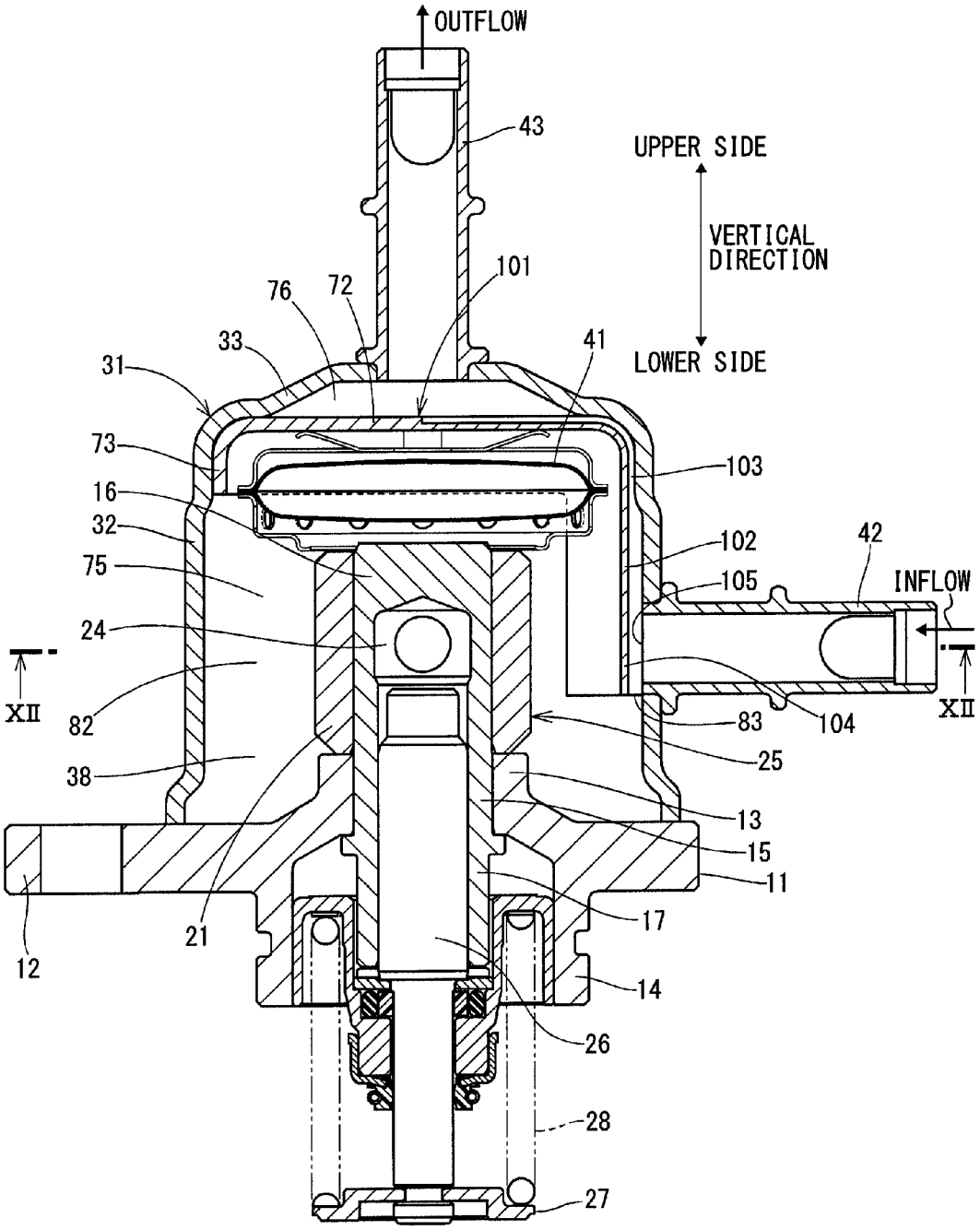
FIG. 11 is a partial cross-sectional view of a high pressure pump according to a seventh embodiment of the present disclosure.
Figure 12:
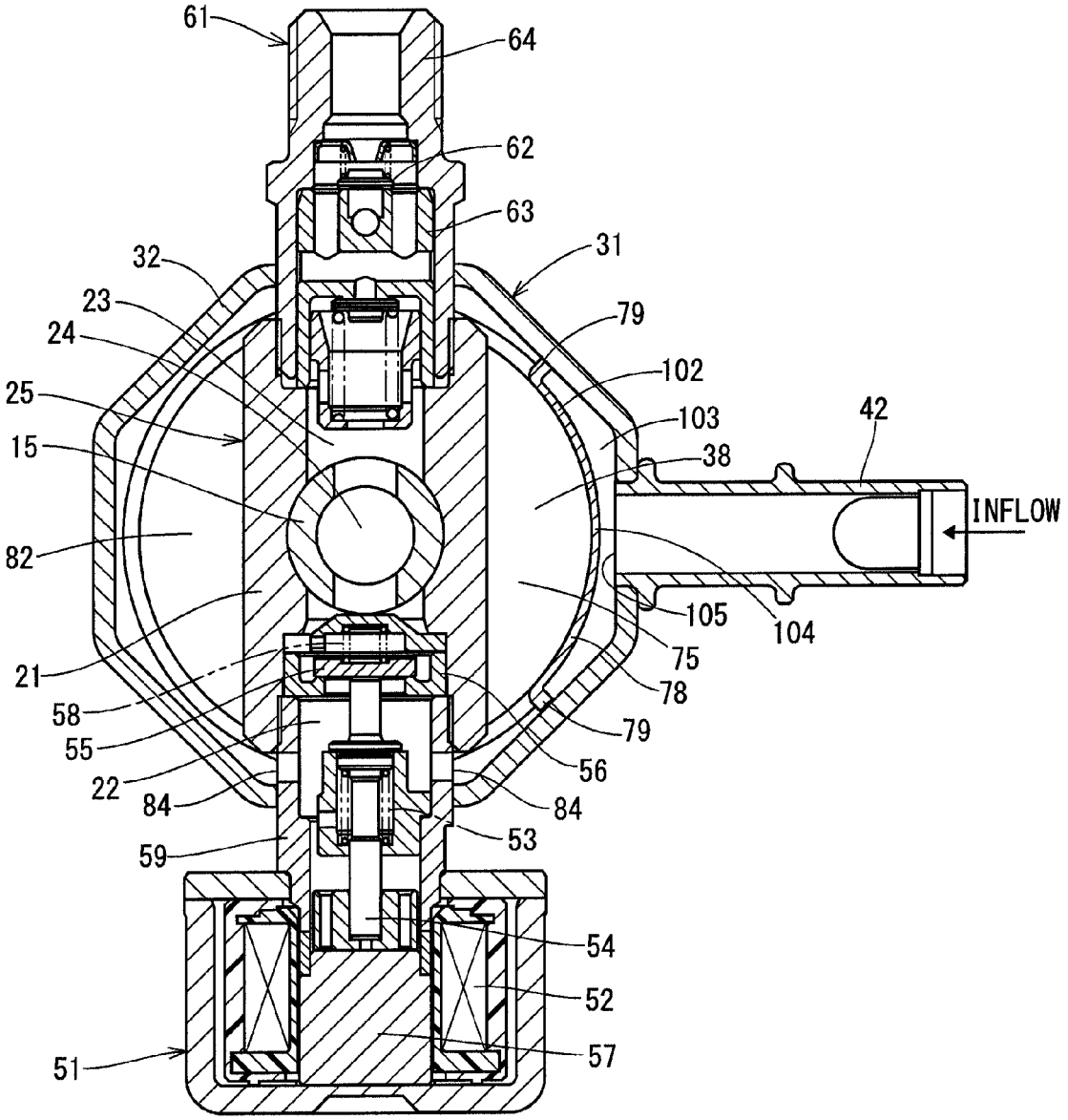
FIG. 12 is a cross sectional view taken along line XII-XII in FIG. 11.

In contrast, as shown in FIGS. 11 and 12, according to a seventh embodiment of the present disclosure, a circumferential position of the inflow pipe 42 overlaps with a circumferential position of the flow passage forming portion 102 of the partitioning member 101. That is, the communicating flow passage 103 is directly communicated with the inside flow passage of the inflow pipe 42 without passing through the first space 75.

Furthermore, the flow passage forming portion 102 includes a blocking portion 104, which blocks at least a portion of a connection between the first space 75 and the inside flow passage of the inflow pipe 42. In the present embodiment, the flow passage forming portion 102 extends to a lower side of an opening 105 of the inflow pipe 42, which opens to the first space 75. That is, when the first space 75 is viewed from the inside flow passage of the inflow pipe 42, the blocking portion 104 entirely blocks the opening 105. Here, the words "entirely blocks the opening 105" do not mean that the blocking portion 104 contacts and closes the opening 105. That is, the words "entirely blocks the opening 105" mean that although the blocking portion 104 and the opening 105 are spaced away from each other, the blocking portion 104 entirely overlaps with the opening 105 in the view taken form the first space 75 side, so that the opening 105 cannot be seen from the first space 75 side.

Therefore, according to the seventh embodiment, the fuel of the inflow pipe 42 can flow to the outflow pipe 43 through the second space 76 without flowing across the first space 75. The majority of the fuel, which flows from the inflow pipe 42 into the inside of the cover 31, collides against the blocking portion 104 and thereby changes the flow direction of the fuel, so that the majority of the fuel is guided to the second space 76. In this way, the fuel pressure pulsation of the damper chamber 81 is not easily applied to the fuel, which flows from the inflow pipe 42 and is outputted from the outflow pipe 43 to the outside after passing through the communicating flow passage 103. Therefore, the pressure of the fuel at the supply destination, such as the low pressure fuel rail, can be stabilized, and thereby the injection quantity of the fuel through the low pressure fuel injection valves can be stabilized.

Eighth Embodiment

Figure 13:
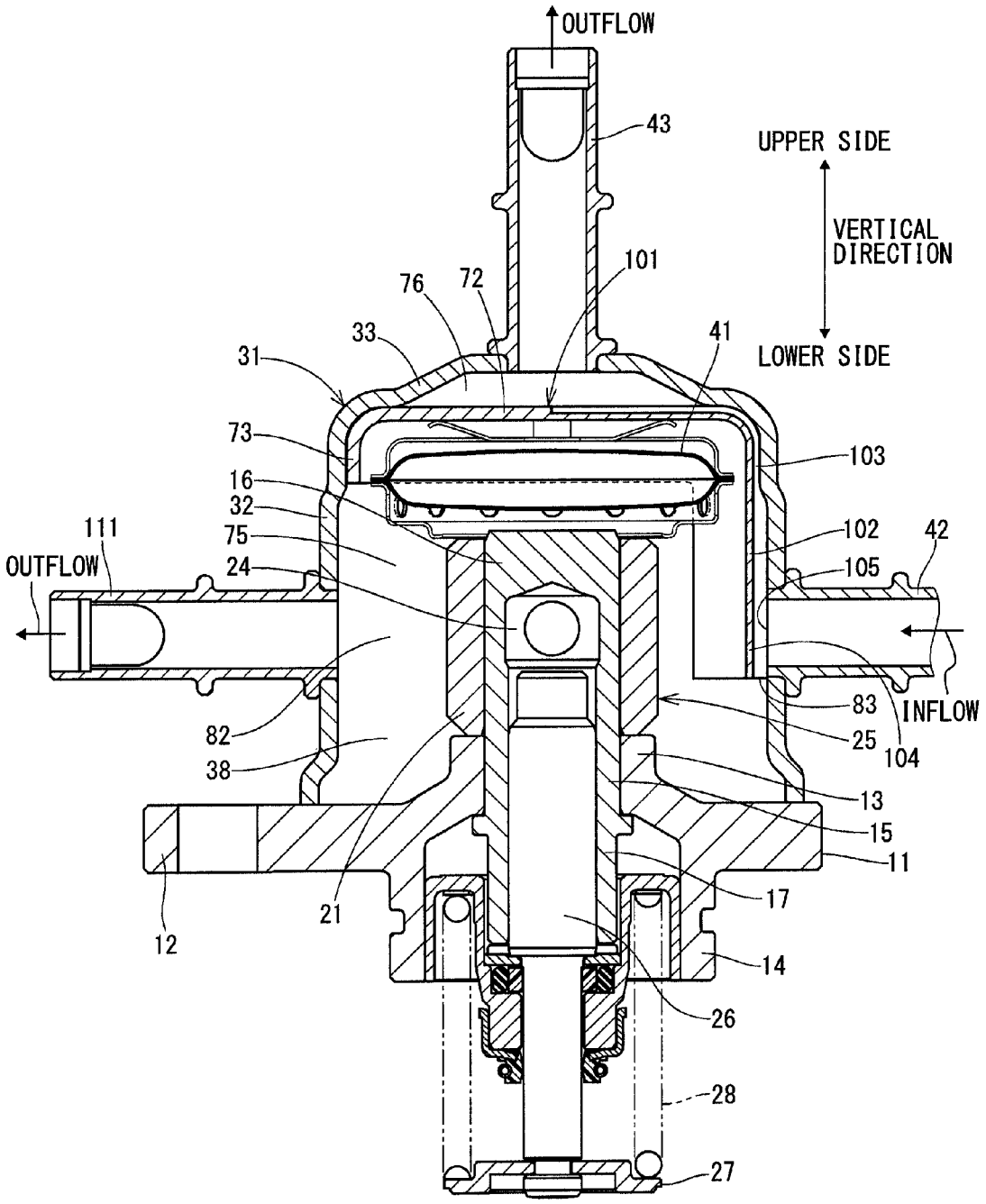
FIG. 13 is a partial cross-sectional view of a high pressure pump according to an eighth embodiment of the present disclosure.
Figure 14:
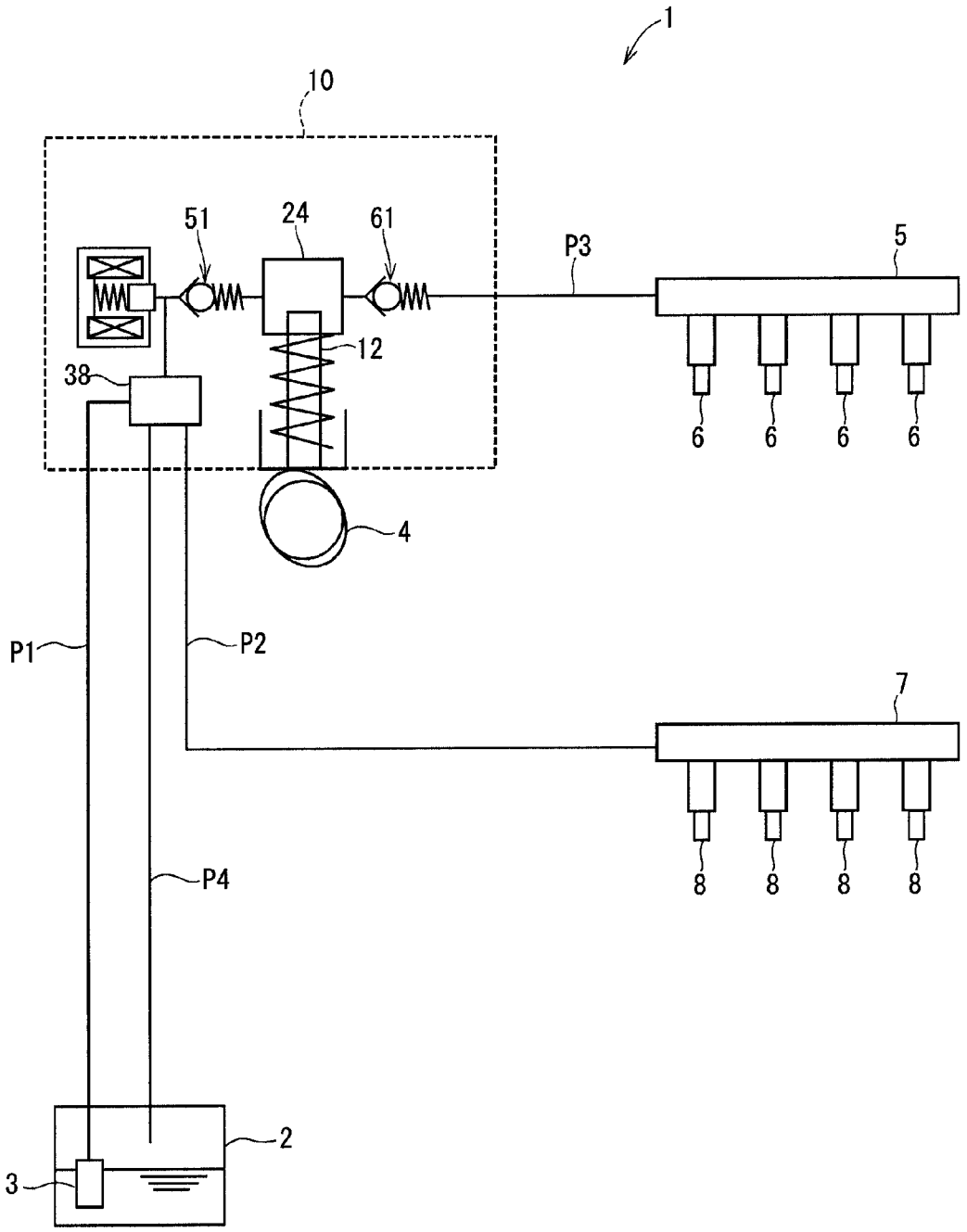
FIG. 14 is a schematic diagram showing a fuel injection system having the high pressure pump of FIG. 13.

As shown in FIG. 13, according to an eighth embodiment of the present disclosure, two outflow pipes 43, 111 are installed to the cover 31. A circumferential position of the outflow pipe 111 does not overlap with a circumferential position of the flow passage forming portion 102, and the outflow pipe 111 is directly communicated with the annular flow passage 82. As shown in FIG. 14, the outflow pipe 111 is communicated with the fuel tank 2 through a low pressure fuel conduit P4. Thus, the advantages, which are similar to those of the seventh embodiment, can be achieved. Also, the flow of the fuel from the inflow pipe 42 to the fuel tank 2 through the annular flow passage 82 and the outflow pipe 111 can be formed. The pressurizing chamber forming portion 25 can be effectively cooled with this flow of the fuel.

Ninth Embodiment

Figure 15:
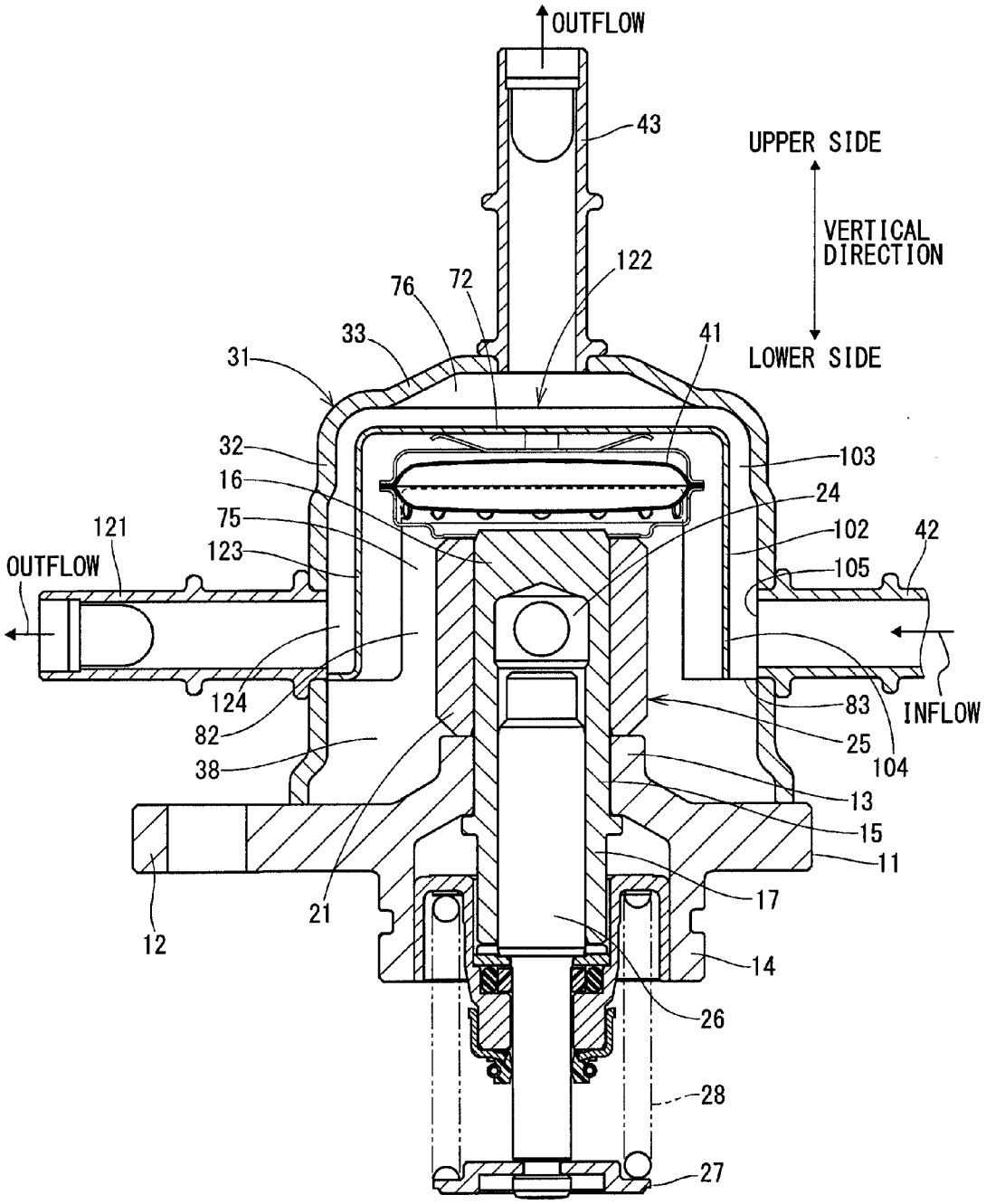
FIG. 15 is a partial cross-sectional view of a high pressure pump according to a ninth embodiment of the present disclosure.

As shown in FIG. 15, according to a ninth embodiment of the present disclosure, two outflow pipes 43, 121 are installed to the cover 31. A circumferential position of the outflow pipe 121 does not overlap with a circumferential position of the flow passage forming portion 102. The partitioning member 122 includes a flow passage forming portion 123, which extends from the partitioning portion 72 to the first space 75 side. The flow passage forming portion 123 includes a communicating flow passage 124, which communicates between the second space 76 and the inside flow passage of the outflow pipe 121. The communicating flow passage 124 is blocked from the first space 75. Specifically, the communicating flow passage 124 is not directly communicated with the first space 75. The communicating flow passage 103 corresponds to a first communicating flow passage of the present disclosure, and the flow passage forming portion 102 corresponds to a first flow passage forming portion of the present disclosure. The communicating flow passage 124 corresponds to a second communicating flow passage of the present disclosure, and the flow passage forming portion 123 corresponds to a second flow passage forming portion of the present disclosure.

Figure 16:
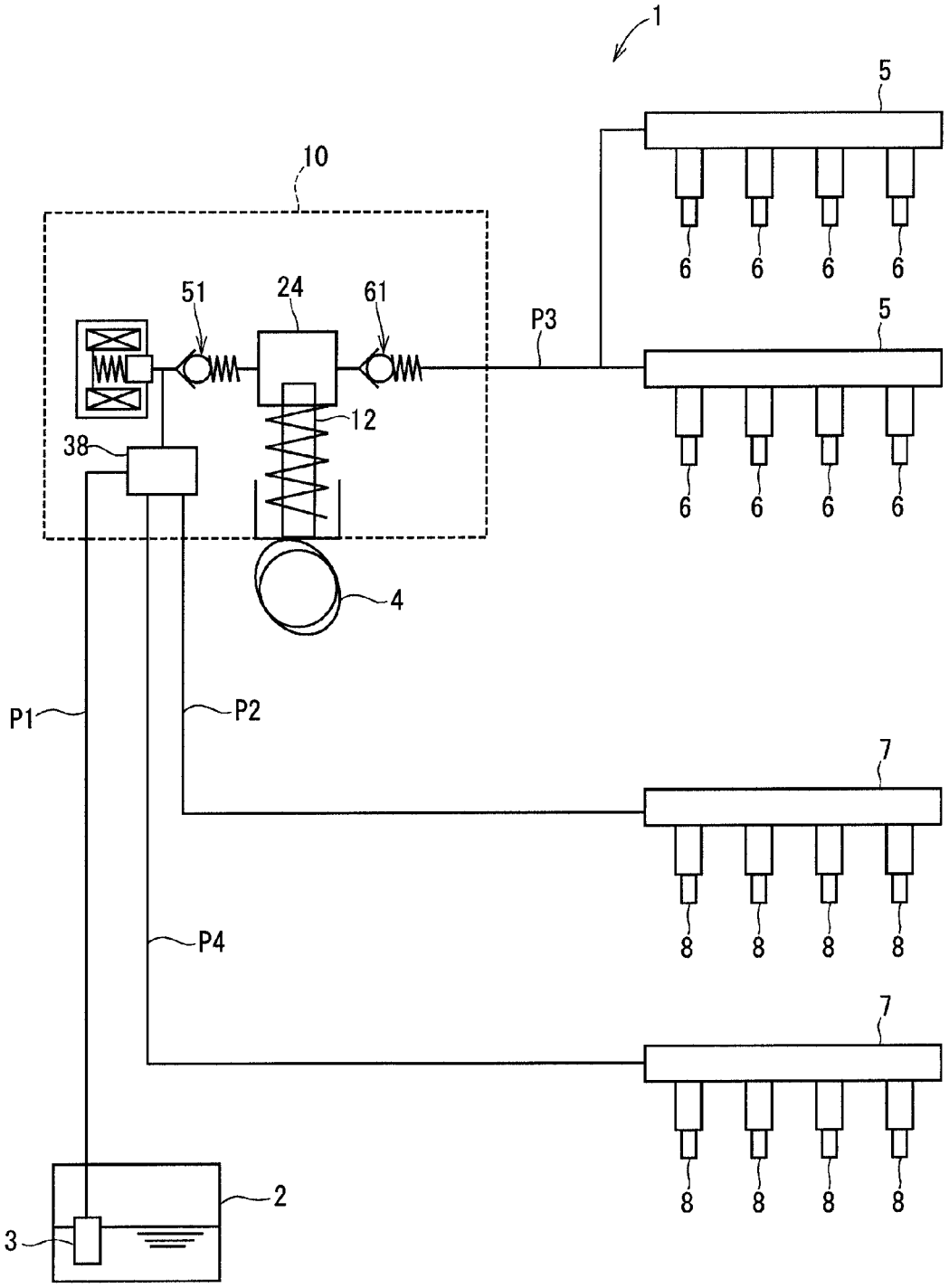
FIG. 16 is a schematic diagram showing a fuel injection system having the high pressure pump of FIG. 15.

In the ninth embodiment, as shown in FIG. 16, the outflow pipe 121 is communicated with the other low pressure fuel rail 7 through the low pressure fuel conduit P4.

As discussed above, the present disclosure may be applied to the case where the two outflow pipes 43, 121 are installed to the cover 31, and the two low pressure fuel rails 7 are provided like in a case of a V-type engine.

Other Embodiments

In another embodiment of the present disclosure, the flow passage forming portion may be formed by another member, which is other than the partitioning member. For example, the flow passage forming portion may be formed by the inflow pipe.

In another embodiment of the present disclosure, a portion of the communicating flow passage may be directly communicated with the inside flow passage of the inflow pipe without passing through the first space. Even in this embodiment, the conduction of the fuel pressure pulsation of the damper chamber to the fuel, which is supplied from the outflow pipe through the communicating flow passage, is further limited in comparison to the first embodiment.

In another embodiment of the present disclosure, the pulsation damper may be eliminated.

In another embodiment of the present disclosure, the opening of the communicating flow passage, which is located on the first space side, may be placed on the side of the pressurizing chamber forming portion where the inflow pipe is located.

In another embodiment of the present disclosure, the opening of the communicating flow passage, which is located on the first space side, may be placed in the damper chamber. That is, the flow passage forming portion is not required to extend to the annular flow passage.

In another embodiment of the present disclosure, the high pressure pump may be installed in the vehicle in any state regardless the vertical direction.

In another embodiment of the present disclosure, the housing may be formed by one or two members or may be formed by four or more members.

The present disclosure is not limited the above embodiments. That is, the above embodiments may be further modified or combined in various ways without departing from the principle of the present disclosure.

What is claimed is:

1. A high pressure pump comprising:

a housing that includes a pressurizing chamber forming portion, which forms a pressurizing chamber;

a plunger that is movable to increase and decrease a volume of the pressurizing chamber;

a cover that defines a fuel chamber between the cover and the housing, wherein the fuel chamber is communicable with the pressurizing chamber;

a primary inside-to-outside communicating portion that communicates between the fuel chamber and an outside;

a secondary inside-to-outside communicating portion that communicates between the fuel chamber and the outside;

a partitioning portion that partitions the fuel chamber into:

a first space, which receives the pressurizing chamber forming portion and is communicated with an inside flow passage of the primary inside-to-outside communicating portion; and a second space, which is communicated with an inside flow passage of the secondary inside-to-outside communicating portion;

a flow passage forming portion that forms a communicating flow passage, which extends from the partitioning portion toward the first space side and communicates between the first space and the second space; and a pulsation damper that is placed in the first space and is deformable in response to a pressure of fuel in the first space to reduce pressure pulsation of the fuel in the first space, wherein the pulsation damper is placed between the pressurizing chamber forming portion and the partitioning portion in an axial direction of the plunger and is spaced away from the partitioning portion in the axial direction of the plunger to enable accumulation of air bubbles contained in the fuel in a space formed between the pulsation damper and the partitioning portion.

2. The high pressure pump according to claim 1, wherein at least a portion of the communicating flow passage is directly communicated with the inside flow passage of the primary inside-to-outside communicating portion without passing through the first space.

3. The high pressure pump according to claim 2, wherein the flow passage forming portion includes a blocking portion that blocks at least a portion of a connection between the first space and the inside flow passage of the primary inside-to-outside communicating portion.

4. The high pressure pump according to claim 3, wherein when the first space is viewed from the primary inside-to-outside communicating portion, the blocking portion entirely blocks an opening of the primary inside-to-outside communicating portion, which opens to the first space.

5. The high pressure pump according to claim 1, wherein:

the primary inside-to-outside communicating portion is an inflow portion, through which fuel is supplied to the fuel chamber;

the secondary inside-to-outside communicating portion is an outflow portion, through which the fuel is outputted from the fuel chamber, and the secondary inside-to-outside communicating portion is one of at least two secondary inside-to-outside communicating portions;

the communicating flow passage is a first communicating flow passage;

the flow passage forming portion is a first flow passage forming portion; and the high pressure pump further comprises a second flow passage forming portion that forms a second communicating flow passage, which extends from the partitioning portion toward the first space side and is blocked from the first space, while the second communicating flow passage communicates between the second space and the inside flow passage of the secondary inside-to-outside communicating portion.

6. The high pressure pump according to claim 1, wherein an opening of the communicating flow passage, which opens to the first space, is located on a side of the pressurizing chamber forming portion, which is opposite from the primary inside-to-outside communicating portion.

7. The high pressure pump according to claim 1, wherein:

the primary-inside-to outside communicating portion is an inflow portion, through which fuel is supplied to the fuel chamber; and the secondary inside-to-outside communicating portion is an outflow portion, through which the fuel is outputted from the fuel chamber.

8. The high pressure pump according to claim 1, wherein:

the secondary inside-to-outside communicating portion is an inflow portion, through which fuel is supplied to the fuel chamber; and the primary inside-to-outside communicating portion is an outflow portion, through which the fuel is outputted from the fuel chamber.

9. The high pressure pump according to claim 1, further comprising a tubular portion that is configured into a tubular form and projects from the partitioning portion toward the pressurizing chamber forming portion side.

10. The high pressure pump according to claim 1, wherein:

the flow passage forming portion is formed such that an opening of the communicating flow passage, which opens to the first space, is located on a side of the pulsation damper where the pressurizing chamber forming portion is placed.

11. The high pressure pump according to claim 1, wherein the first space includes:

a damper chamber that is defined at a location between the pressurizing chamber forming portion and the partitioning portion and receives the pulsation damper; and an annular flow passage that surrounds the pressurizing chamber forming portion and is communicated with the inside flow passage of the primary inside-to-outside communication portion.

12. The high pressure pump according to claim 11, wherein the flow passage forming portion is formed such that an opening of the communicating flow passage, which opens to the first space, is located in the annular flow passage.

13. The high pressure pump according to claim 11, wherein:

the pressurizing chamber forming portion or a member, which is fixed to the pressurizing chamber forming portion, includes an inlet of a suction flow passage that communicates between the first space and the pressurizing chamber; and an opening of the communicating flow passage, which opens to the first space, is placed at a location that does not overlap with the inlet in a circumferential direction along the annular flow passage.

14. A high pressure pump comprising:

a housing that includes a pressurizing chamber forming portion, which forms a pressurizing chamber;

a plunger that is movable to increase and decrease a volume of the pressurizing chamber;

a cover that defines a fuel chamber between the cover and the housing, wherein the fuel chamber is communicable with the pressurizing chamber;

a primary inside-to-outside communicating portion that communicates between the fuel chamber and an outside;

a secondary inside-to-outside communicating portion that communicates between the fuel chamber and the outside;

a partitioning portion that partitions the fuel chamber into:

a first space, which receives the pressurizing chamber forming portion and is communicated with an inside flow passage of the primary inside-to-outside communicating portion; and a second space, which is communicated with an inside flow passage of the secondary inside-to-outside communicating portion; and a flow passage forming portion that forms a communicating flow passage, which extends from the partitioning portion toward the first space side and communicates between the first space and the second space, wherein at least a portion of the communicating flow passage is directly communicated with the inside flow passage of the primary inside-to-outside communicating portion without passing through the first space.

15. A high pressure pump comprising:

a housing that includes a pressurizing chamber forming portion, which forms a pressurizing chamber;

a plunger that is movable to increase and decrease a volume of the pressurizing chamber;

a cover that defines a fuel chamber between the cover and the housing, wherein the fuel chamber is communicable with the pressurizing chamber;

a primary inside-to-outside communicating portion that communicates between the fuel chamber and an outside;

a secondary inside-to-outside communicating portion that communicates between the fuel chamber and the outside;

a partitioning portion that partitions the fuel chamber into:

a first space, which receives the pressurizing chamber forming portion and is communicated with an inside flow passage of the primary inside-to-outside communicating portion; and a second space, which is communicated with an inside flow passage of the secondary inside-to-outside communicating portion; and a flow passage forming portion that forms a communicating flow passage, which extends from the partitioning portion toward the first space side and communicates between the first space and the second space, wherein:

the primary inside-to-outside communicating portion is an inflow portion, through which fuel is supplied to the fuel chamber;

the secondary inside-to-outside communicating portion is an outflow portion, through which the fuel is outputted from the fuel chamber, and the secondary inside-to-outside communicating portion is one of at least two secondary inside-to-outside communicating portions;

the communicating flow passage is a first communicating flow passage;

the flow passage forming portion is a first flow passage forming portion; and the high pressure pump further comprises a second flow passage forming portion that forms a second communicating flow passage, which extends from the partitioning portion toward the first space side and is blocked from the first space, while the second communicating flow passage communicates between the second space and the inside flow passage of the secondary inside-to-outside communicating portion.

16. A high pressure pump comprising:

a housing that includes a pressurizing chamber forming portion, which forms a pressurizing chamber;

a plunger that is movable to increase and decrease a volume of the pressurizing chamber;

a cover that defines a fuel chamber between the cover and the housing, wherein the fuel chamber is communicable with the pressurizing chamber;

a primary inside-to-outside communicating portion that communicates between the fuel chamber and an outside;

a secondary inside-to-outside communicating portion that communicates between the fuel chamber and the outside;

a partitioning portion that partitions the fuel chamber into:

a first space, which receives the pressurizing chamber forming portion and is communicated with an inside flow passage of the primary inside-to-outside communicating portion; and a second space, which is communicated with an inside flow passage of the secondary inside-to-outside communicating portion; and a flow passage forming portion that forms a communicating flow passage, which extends from the partitioning portion toward the first space side and communicates between the first space and the second space, wherein:

an opening of the communicating flow passage, which opens to the first space, is located on a side of the pressurizing chamber forming portion, which is opposite from the primary inside-to-outside communicating portion.

17. A high pressure pump comprising:

a housing that includes a pressurizing chamber forming portion, which forms a pressurizing chamber;

a plunger that is movable to increase and decrease a volume of the pressurizing chamber;

a cover that defines a fuel chamber between the cover and the housing, wherein the fuel chamber is communicable with the pressurizing chamber;

a primary inside-to-outside communicating portion that communicates between the fuel chamber and an outside;

a secondary inside-to-outside communicating portion that communicates between the fuel chamber and the outside;

a partitioning portion that partitions the fuel chamber into:

a first space, which receives the pressurizing chamber forming portion and is communicated with an inside flow passage of the primary inside-to-outside communicating portion; and a second space, which is communicated with an inside flow passage of the secondary inside-to-outside communicating portion;

a flow passage forming portion that forms a communicating flow passage, which extends from the partitioning portion toward the first space side and communicates between the first space and the second space; and a pulsation damper that is placed in the first space and is deformable in response to a pressure of fuel in the first space to reduce pressure pulsation of the fuel in the first space, wherein the first space includes:

a damper chamber that is defined at a location between the pressurizing chamber forming portion and the partitioning portion and receives the pulsation damper; and an annular flow passage that surrounds the pressurizing chamber forming portion and is communicated with the inside flow passage of the primary inside-to-outside communication portion.

* * * * *